United States Patent [19]

Labbe

[11] 4,168,712

[45] Sep. 25, 1979

[54] EXTENDED SHEET CIGARETTE FILLER

[75] Inventor: Francis A. M. Labbé, Neuilly-sur-Seine, France

[73] Assignee: Molins Limited, United Kingdom

[21] Appl. No.: 704,032

[22] Filed: Jul. 9, 1976

Related U.S. Application Data

[63] Continuation of Ser. No. 703,482, Jul. 8, 1976.

[30] Foreign Application Priority Data

Jul. 8, 1975 [GB] United Kingdom ..... 28769/75

[51] Int. Cl.[2] ..... A24D 1/00; A24B 3/14

[52] U.S. Cl. ..... 131/8 R; 131/20 A; 131/31; 131/62; 131/84 R; 131/140 C

[58] Field of Search ..... 131/62, 63, 64, 79, 131/8, 20, 20 A, 21, 15, 27, 31, 84 R, 84 A, 84 C, 133, 140 C, 261 A, 261 B; 93/1

[56] References Cited

U.S. PATENT DOCUMENTS

| | | | |
|---|---|---|---|
| 3,188,924 | 6/1965 | Davey et al. | 93/1 |
| 3,402,722 | 9/1968 | Kochalski | 131/20 A |
| 3,431,915 | 3/1969 | Licis | 131/20 A |
| 3,472,236 | 10/1969 | Dearszey | 131/64 R X |
| 3,472,236 | 10/1969 | Dearsley | 131/64 R |
| 3,750,675 | 8/1973 | Klemme | 131/21 D X |

*Primary Examiner*—Stephen C. Pellegrino
*Attorney, Agent, or Firm*—Craig and Antonelli

[57] ABSTRACT

Cigarettes or cigarette filters are made by forming a filler by feeding continuously at least one web of filler material which has lines of spaced slits extending across the width of the web, the slits in each line being offset from those in adjacent lines; stretching the web so as to open up the slits while distorting out of their original plane the interconnected strip-like portions of the web left between the slits; compressing the web laterally to form a filler; enclosing the thus-formed filler in a wrapper to form a continuous rod; and cutting the continuous rod into individual portions.

9 Claims, 14 Drawing Figures

Fig. 3.
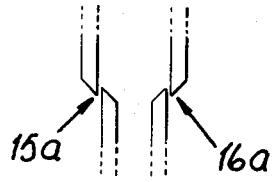
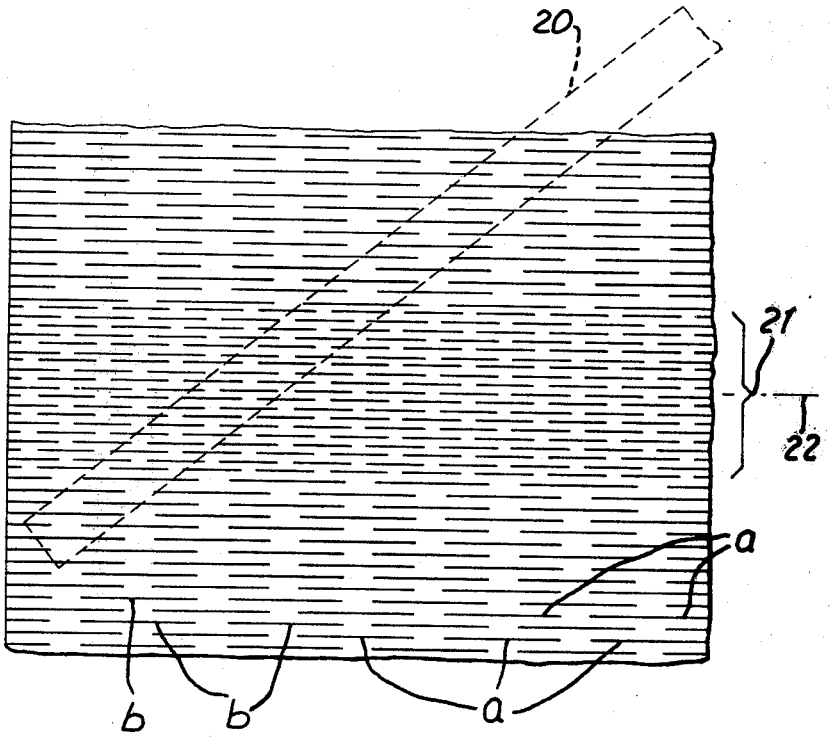
Fig. 4.

EXTENDED SHEET CIGARETTE FILLER

This application is a continuation of U.S. application Ser. No. 703,482 filed, July 8, 1976.

This invention concerns improvements in the manufacture of articles of the tobacco industry, in particular cigarettes and filters for cigarettes, which are made wholly or partly from sheet material such as reconstituted tobacco or synthetic smoking material in the case of cigarettes, or from filter paper in the case of filters.

According to one aspect of this invention the manufacture of rod-like articles of the tobacco industry comprising a filler with a surrounding wrapper includes the steps of forming the filler by feeding continuously at least one web of filler material which has lines of spaced slits extending across the width of the web, the slits in each line being offset from those in adjacent lines; stretching the web so as to open up the slits while distorting out of their original plane the interconnected strip-like portions of the web left between the slits; compressing the web laterally to form a filler; enclosing the thus-formed filler in a wrapper to form a continuous rod; and cutting the continuous rod into individual portions.

For example, the web may be fed continuously lengthwise, at a predetermined speed, to a slitting device such as one or more pairs of opposed slitting rollers provided with suitably disposed slitting knives, and after being slit may be drawn, at a speed greater than the said predetermined speed, into a rod-forming device in which it is compressed to rod form.

By a suitable choice of the size and spacing of the slits and of the speed difference which causes stretching of the web, it is possible to determine to a great extent the the disposition of the partially-separated but interconnected portions of the web in the final rod, in particular their general inclination to the rod axis. This gives the possibility of a measure of control over certain characteristics of the rod such as density and pressure drop, and control over the "filling power" of the filling material; i.e. the ability of a given quantity of filling material, which in this case consists at least in part of the slit sheet material, to impart firmness to the rod. In addition, it is possible to vary the characteristics of the rod in a given length (e.g. a cigarette length) by cyclically varying the stretch, e.g. by means of a varying speed difference or by arranging for the spacing and/or length of the slits to vary along the length of the web.

Two or more webs may be used simultaneously, each being slit and stretched and both being drawn into the same rod-forming device.

It is also possible, in making cigarettes, to add natural tobacco shreds or processed (e.g. "puffed") stem to the web, preferably after stretching, for incorporation in the rod. Entrainment of the tobacco shreds is assisted by the roughness of the stretched distorted web and may be further assisted by suction applied through the stretched web. Again, in making filters, fibrous or powdered material may be added to the web; this process may be assisted by electrostatically charging the web. The stretching of the web may be utilised to influence the orientation of tobacco shreds or other fibrous particles deposited on it; if they are deposited on the unstretched web, subsequent stretching will tend to align them lengthwise the web; while it is possible, of the other hand, to stretch the web excessively before depositing the shreds or fibres, and then to shrink it, which tends to arrange them more or less perpendicularly to the rod axis.

Methods and machines in accordance with the invention will now be described with reference to the accompanying diagrammatic drawings, in which:

FIG. 3 shows an arrangement of knives in the FIG. 2 arrangement;

FIG. 4 shows an arrangement of slits in a web;

Figure 7:
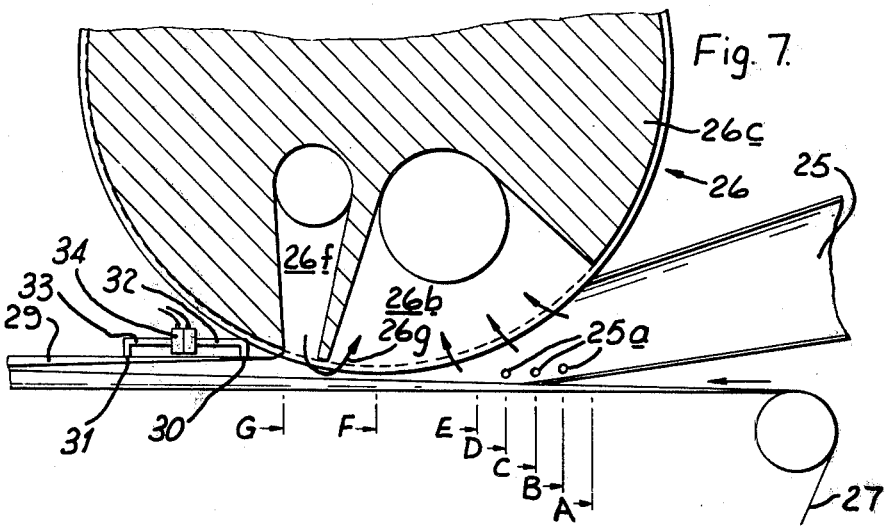
FIG. 7 shows an alternative arrangement for compressing a filler web.
Figure 8A:
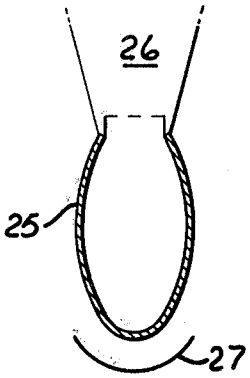
Figure 8B:
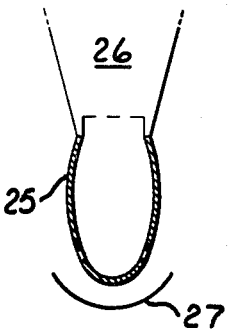
Figure 8C:
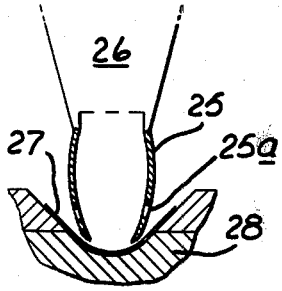
Figure 8D:
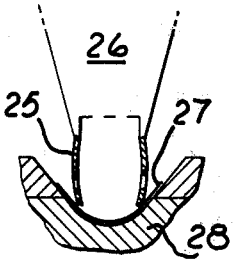
Figure 8E:
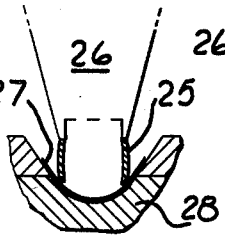
Figure 8F:
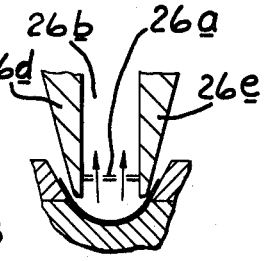
Figure 8G:
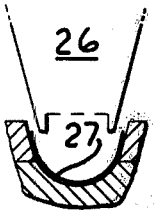

FIGS. 8A to G are sections on the lines A to G in FIG. 7.

Figure 1:
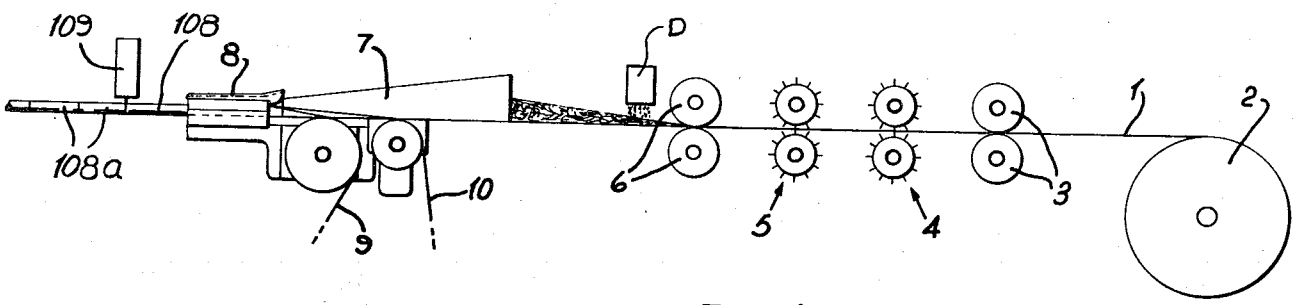
FIG. 1 shows diagrammatically a machine for feeding, slitting and stretching a web and forming it into a rod.

In the construction shown in FIG. 1, a web 1 of sheet material is drawn from a bobbin 2 by a pair of variable speed feed rollers 3. The sheet material may be of reconstituted tobacco, or of synthetic smoking material, if the device is used for making cigarettes, or may be of a suitable paper if filters are to be made. Two pairs of slitting rollers 4, 5 are arranged between the feed rollers 3 and a further pair of variable speed feed rollers 6. Beyond the rollers 6 is a condensing cone 7, similar to cones used in certain known methods and devices for producing filters from webs of paper, and beyond that is a rod-forming device 8 which may also be of known kind. A tape 9, carrying a paper strip 10, is arranged to travel through the rod-forming device in known manner to seal the paper strip around the filler formed by the web 1.

The feed rollers 3 and 6 grip the web and convey it at a predetermined speed which is less than the speed of the tape 9 and paper strip 10, and the speed of rotation of the slitting rollers 4, 5 is such that their peripheral velocities correspond to the web speed.

Figure 6:
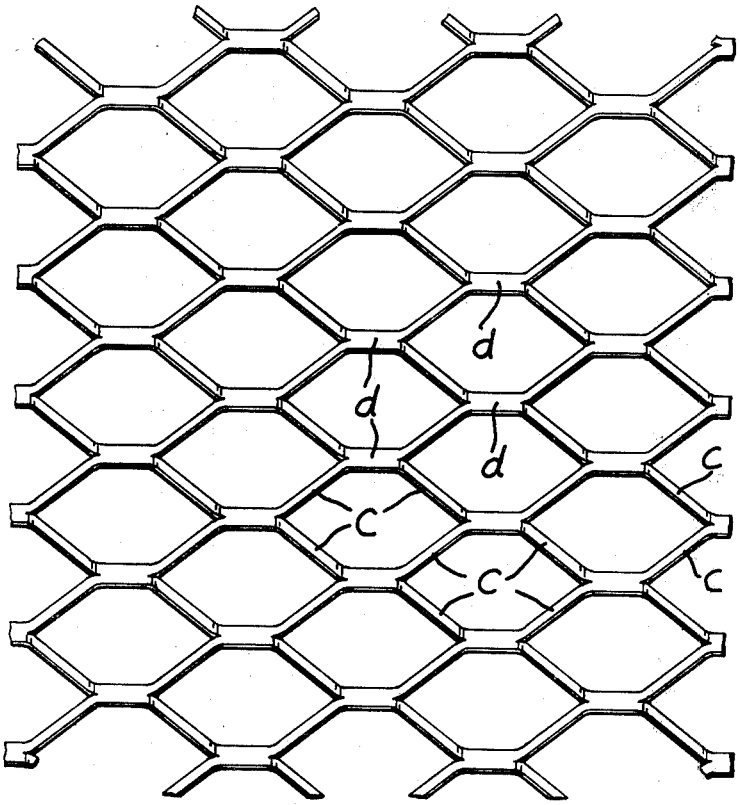
FIG. 6 shows the FIG. 5 portion of web in the stretched condition.

The slitting rollers are provided with small slitting knives or cutters so disposed about and along the rollers as to produce in the web a pattern of slits such as is illustrated in FIG. 4. The knives on the rollers 4 are so positioned as to make a succession of lines of slits a extending across the width of the web, i.e. transversely of its length, while the knives of the rollers 6 are positioned so as to make, between the lines of slits, a succession of lines of slits b. The slits a and b are of the same length (except, in the example shown, that those of the slits b occurring at the web margins are shorter) but the lines of slits a are uniformly offset from those of the slits b. This produces in the web a pattern of interconnected strip like portions c (see FIG. 6), extending across the whole of the web and lying between adjacent lines of slits, the portions c being interconnected by small portions d of the web lying between adjacent ends of slits and thus offset from each other. This arrangement of slits enables the web to be stretched lengthwise, since the striplike portions between lines of slits can be pulled apart and the slits thereby opened, as shown in FIG. 6; such stretching of the web results in distortion of the striplike portions c (the portions c and also the portions d becoming inclined to the general plane of the web) and, incidentally, also results in narrowing of the slit web.

This opening up and stretching of the web occurs as it leaves the feed rollers 6 and assumes the speed of the tape 9 and paper strip 10. Immediately thereafter it is drawn into the cone 7 whereby it is compressed laterally to roughly a cylindrical shape (accompanied by random or partly predetermined longitudinal folding of the web), and in that condition it is surrounded by the paper strip 10 and carried through the rod-forming device 8. A continuous rod 108 emerges from the device 8 and is cut at regular intervals by a cutting device 109 to produce individual rod portions 108A.

Since the web, while moving towards the rod-forming device, is maintained in its stretched condition and has no opportunity to close up endwise, the distorted portions tend to remain inclined to the lengthwise feed direction, and although their positions may be modified by the compressing action of the cone 7 and rod-forming device 8, nevertheless at least a good number of them remain generally inclined to the axis of the rod when this has been made. It is believed that if the size and disposition of the slits, and the amount by which the web is stretched, are suitably chosen for a web of a given nature, a substantially predetermined orientation of the interconnected striplike portions relative to the axis of the finished rod can be obtained, in an arrangement which is to some extent similar to the arrangement of tobacco shreds within a conventional cigarette.

Shreds of tobacco or other particles may be deposited on the web by depositing means D, in a manner known per se, e.g., after the web has been stretched.

Instead of the rollers 6 or 3, which drive the web by pinching, a single roller may in each case be used with an air-pervious periphery through which suction is transmitted from within the roller so as to grip and frictionally drive the web without a pinching action.

Figure 2:
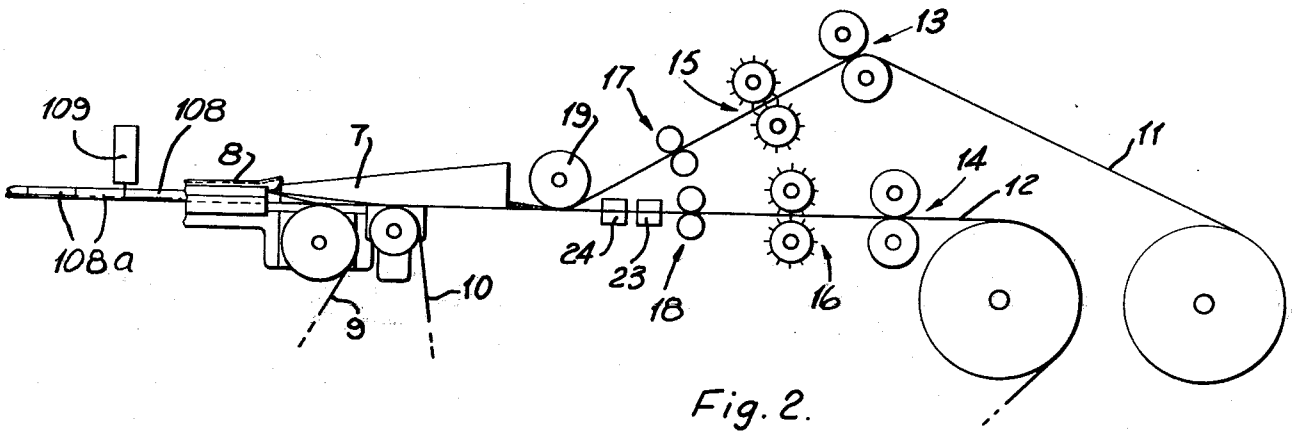
FIG. 2 shows an alternative arrangement for dealing with two webs.

FIG. 2 shows diagrammatically an alternative arrangement in which two webs 11 and 12 are fed and slit simultaneously. The two webs are fed by pairs of feed rollers 13 and 14; after being slit by slitting rollers 15 and 16 respectively, both are drawn into the cone 7 in a stretched condition, one above the other, being fed via rollers 17 and 18. A guide roller 19 guides the upper web and superimposes it on the lower web just before they enter the cone. In this arrangement it should be ensured that the two stretched and opened webs do not interlock or "nest" when superimposed, and one way of doing this is to arrange that the relative positions of the knives on the slitting rollers 15 are opposite to those of the knives on the rollers 16, as indicated in FIG. 3, in which a pair of knives on the rollers 15 is shown as 15A, and a pair on the rollers 16 as 16A.

Stretching may begin immediately after the slitting rollers (for example, by omitting the rollers 17 and 18) especially on the case of relatively strong web material. However, if the web material is relatively weak then in order to avoid any risk of tearing the web, the rollers 17 and 18 should be included. These rollers 17 and 18 may rotate with a peripheral speed equal to that of the feed rollers 13 and 14 and slitting rollers 15 and 16 or may alternatively run at a slightly higher speed so that slight stretching of the web occurs immediately downstream of the slitting rollers to assist the slitting operation.

The web 1 in FIG. 1 and one or both of the webs shown in FIG. 2 (assuming they are being used for the manufacture of cigarettes) may have shreds of tobacco showered downwards onto it through a channel 20 shown in broken outline in FIG. 4. The channel extends obliquely across the web and may have tobacco delivered into it by a band (not shown) moving in a direction at right angles to the channel in a well-known manner.

Again on the assumption that the web 1 is used for the manufacture of cigarettes, the slitting rollers are arranged to produce, at regular intervals along the web, areas 21 in which the slits are shorter and are closer together as shown in FIG. 4. These areas provide the end portions of the fillers of the finished cigarettes, for which purpose the final cutting device 109 may be timed to cut the continuous rod through the middle of the areas 21, i.e. on lines 22. The slit length and spacing in the areas 21 provide the cigarettes with narrower strip portions (giving the appearance of more finely cut tobacco) and with firmer ends.

In the manufacture of cigarettes, the web (or webs) may be impregnated by means of sprays with fragrant additives, and such sprays may be programmed so as to vary the taste of consecutive puffs of a cigarette. Similarly, the nicotine content may be increased (e.g. as described in British Pat. No. 1,391,694) and/or may be varied along each cigarette so as to balance the regenerative effect during the last puffs. Another possiblity is that the web or webs may be sprayed with a binder (for example, carboxy methyl cellulose) to help to ensure that pieces of the filler web do not fall out of the ends of the cigarettes during subsequent conveyance of the cigarettes. For example, as shown in FIG. 2 the web 12 may pass through a chamber 23 in which it is sprayed, and then possibly through an infra-red drying chamber 24 if necessary; the web 11 may pass through similar chambers.

The size and spacing of the slits in a web will, of course, depend not only on desiderate concerning density, pressure drop, and firmness in the final product, but also on the nature of the web material being used, e.g. on its stiffness.

Figure 5:
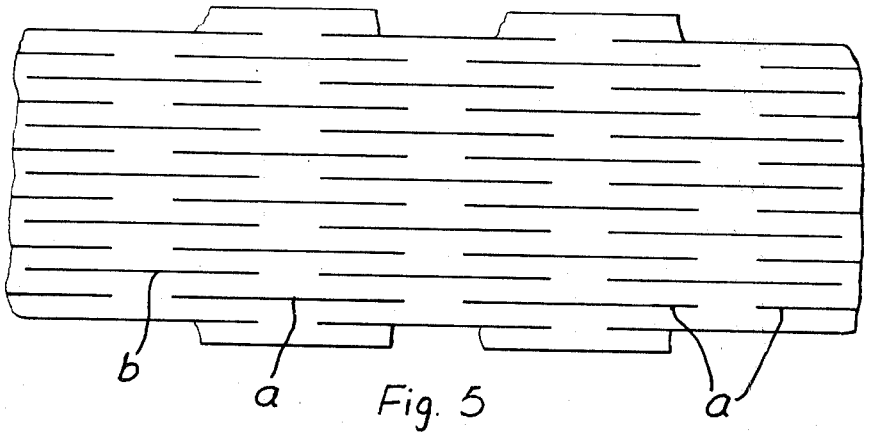
FIG. 5 shows an enlargement of part of the web shown in FIG. 4.

By way of example, a web of reconstituted tobacco may have a weight of 55 grams/square meter with a thickness of about 0.09 mm. In order to form a cigarette filler having a weight per centimeter of about 140 mg and assuming that the web is stretched so as approximately to double its length, the total width of the web should be about 50 centimeters. This can for example be made up of two webs each of 25 centimeter width. It should be noted that FIG. 6, by way of illustration, shows the web of FIG. 5 being stretched to slightly more than double its length. In practice, in order to tilt the strip-like portions c sufficiently, the stretching of the web should increase the length by at least about 50%.

As shown in FIG. 2, two webs may be fed one above the other into the rod-forming device. These webs may be formed by feeding a single double-width web to the machine and then cutting that web longitudinally through the middle. One of the two webs may then be deflected into a position above the other web by means of a number of inclined turning bars or rollers in a well-known manner.

The web or webs may be drawn from a bobbin which is driven at an appropriately controlled speed in a known manner so as to relieve the web of any significant tension, especially when the machine is being started.

When the web on a bobbin expires, any known means may be used to splice the trailing end of the expiring web to the leading end of a web on a fresh bobbin, preferably without stopping the delivery of web to the rod-forming device. A memory device may be provided in a known manner (possibly in association with a splice detector) to cause subsequent ejection of cigarettes which include the splice.

In a cigarette making factory it may be more convenient to keep the bobbins for several adjacent machines at a separate location, instead of providing each machine with the space and facility for storing and unwinding bobbins. In that case, the distance of some machines from their associated bobbin or bobbins may be substantial, and the web may be fed along a supporting plate with apertures through which air is blown to produce at least a partial air bearing between the web and the plate. A number of plates carrying webs to a line of machines may be mounted one above the other to provide a compact web delivery duct which may include air manifolds along opposite sides for respectively delivering air to spaces below the plates and for recirculating back all the air. In other words the air may have a closed circuit via one manifold, the plates, the othermanifold and one or more air pumps. The humidity of the air may be controlled in order to condition the webs as they pcss from the bobbins to the cigarette making machines.

It has been mentioned above that tobacco shreds can be fed on to a web for incorporation in the cigarette rod, or fibrous or powdered material for incorporation in a filter rod. In an arrangement such as shown in FIG. 2, the added materials could be fed on to the lower web so as to be trapped between the two sheets. Although the web itself is likely to be very consistent in density, the addition of loose material may cause variations in the mass per unit length of the rod, and these can if necessary be monitored by a known device, such as a Beta ray measuring device, and the stretching of the web may be varied as required in response to variations so detected.

FIG. 7 and 8A to G show an arrangement for compressing the web or webs by means of a suction wheel. A condensing cone 25 receives the slit web (not shown) and begins the compression of the web. However, the cone 25 is cut away to allow a suction wheel 26 to enter the cone and grip the web to carry out the main compression of web. The wheel 26 has an air-pervious rim **26*a* (see FIG. 8F) through which suction is transmitted from a suction space 26*b* formed in a fixed member 26*c* lying between walls 26*d* and 26*e* of the wheel. The wheel, the cone and a paper wrapper strip 27 form a passage of decreasing cross-section, as shown by FIGS. 8A to E. Further compression by the wheel occurs up to the section line F in FIG. 7, by which point the cone 25 has terminated and the filler web is confined between the wheel and the wrapper strip; the wrapper strip is supported by a bed member 28 (not shown in FIGS. 8A and 8B, which show the wrapper strip 27 slightly further below the cone 25** than it may in practice be at those points).

Downstream of the section line G in FIG. 7 compression and shaping of the cross-section of the web is continued by a tongue 29. This tongue has two apertures providing pressure tappings at longitudinally spaced points 30 and 31 from which pipes 32 and 33 deliver pressure signals to a comparator device 34. An electrical output from the comparator depends upon the pressure different at the two pressure tappings and is indicative of the pressure drop through the web. The output of the comparator (especially in the case of filter manufacture) may be used to vary automatically the amount by which the web is stretched with a view to maintaining the pressure drop substantially constant.

Some of the air which is drawn into the suction chamber **26*b* is supplied from a second chamber 26*f* in the member 26*c* which may be at atmospheric or above-atmospheric pressure. This air flow, which is shown generally by arrow 26*g*, helps to keep clear the outer surface of the rim 26*a* of the wheel. Further air inlets 25*a* may be formed in both sides of the cone 25** as shown.

The web fed to the cone may be uniformly slit (i.e. without the areas 21 of FIG. 4), and the following provision may be made to vary cyclically the amount by which the web is stretched so as to produce denser end portions. A rotary cam-like member is mounted adjacent to the web upstream of the cone, and it rotates in synchronism with the cutting device 109 so as to vary the length of the path along which the web moves. For example, the cam-like member may have a basically circular periphery with a flattened portion, the arrangement being such that the cam-like member most of the time deflects the web to a predetermined extent and deflects the web by a smaller amount (or not at all) when the flattened portion is adjacent to the web.

As an idea of scale, and by way only of example, the width of the portion of web shown in FIG. 4 is about 12 centimeters, the slits a and b being about 2 centimeters long.

In summary, the present invention makes it possible to obtain the advantages of making a rod from a continuous and coherent web of uniform sheet material, while obtaining substantially the apperance (at each end of the finished cigarettes) of cigarettes made in the conventional way from shredded tobacco or from a mixture of shredded materials. The present invention has an advantage over the conventional method in that it provides for a relatively simple control over the characteristics of the finished cigarettes.

I claim:

1. A method of making cigarettes, including the steps of forming the filler for the cigarettes by feeding continuously at least one web of smokable filler material; forming in said web lines of spaced slits extending across the width of the web and including the longitudinal edges thereof, the slits in each line being offset from those in adjacent lines; delivering shreds of tobacco onto the web; then stretching the web so as to open up the slits while distorting out of their original plane the interconnected strip-like portions of the web left between the slits; compressing the stretched web laterally to form a filler; enclosing the thus-formed filler in a wrapper to form a continuous rod; and cutting the continuous rod into individual portions.

2. A method of making cigarettes, including the steps of forming the filler for the cigarettes by feeding continuously at least one web of smokable filler material; forming in said web lines of spaced slits extending across the width of the web and including the longitudinal edges thereof, the slits in each line being offset from those in adjacent lines and the length of the slits and/or the spacing between the slits differing in predetermined regularly spaced areas of the web which are to provide denser end portions of the fillers of the finished cigarettes; stretching the web so as to open up the slits while distorting out of their original plane the interconnected strip-like portions of the web left between the slits; compressing the stretched web laterally to form a filler; enclosing the thus-formed filler in a wrapper to form a continuous rod; and cutting the continuous rod into individual portions.

3. A cigarette making machine comprising first means for conveying a continuous web of smokable filler material at a predetermined speed towards a slitting mechanism, said slitting mechanism including means for producing slits in the web so as to produce lines of spaced slits extending across the width of the web and including the longitudinal edges thereof, the slits in each line being offset from those in adjacent lines; second means for conveying the web, after slitting, at a greater speed than said first means so as to stretch the web, thereby opening up the slits while distorting out of their original plane the interconnected strip-like portions of the web left between the slits; means for compressing the web laterally to form a cigarette filler; means for delivering shreds of tobacco onto the web before the web is compressed to form a cigarette filler; means for enclosing the cigarette filler in a wrapper to form a continuous rod; and a cutting device for cutting the continuous rod into individual portions.

4. A cigarette making machine according to claim 3 including means for spraying flavouring material and/or a binder onto the web before it is compressed.

5. A cigarette making machine comprising first means for conveying a continuous web of smokable filler material at a predetermined speed towards a slitting mechanism, said slitting mechanism including means for producing slits in the web so as to produce lines of spaced slits extending across the width of the web and including the longitudinal edges thereof, the slits in each line being offset from those in adjacent lines and the length of the slits and/or spacing between the slits differing in predetermined regularly spaced areas of the web which provide denser end portions of the fillers of the finished cigarettes; second means for conveying the web, after slitting, at a greater speed than said first means so as to stretch the web, thereby opening up the slits while distorting out of their original plane the interconnected strip-like portions of the web left between the slits; means for compressing the web laterally to form a cigarette filler; means for enclosing the cigarette filler in a wrapper to form a continuous rod; and a cutting device for cutting the continuous rod into individual portions.

6. A cigarette making machine comprising first means for conveying a continuous web of smokable filler material at a predetermined speed towards a slitting mechanism, said slitting mechanism including means for producing slits in the web so as to produce lines of spaced slits extending across the width of the web and including the longitudinal edges thereof, the slits in each line being offset from those in adjacent lines; second means for conveying the web, after slitting, at a greater speed than said first means so as to stretch the web, thereby opening up the slits while distorting out of their original plane the interconnected strip-like portions of the web left between the slits; means for compressing the web laterally to form a cigarette filler; suction conveyor means positioned to converge towards a wrapper so that the web is suctionally gripped by the suction conveyor means and is mechanically compressed between the suction conveyor means and the wrapper prior to being enclosed in the wrapper; means for enclosing the cigarette filler in the wrapper to form a continuous rod; and a cutting device for cutting the continuous rod into individual portions.

7. A cigarette making machine comprising first means for conveying a continuous web of smokable filler material at a predetermined speed towards a slitting mechanism, said slitting mechanism including means for producing slits in the web so as to produce lines of spaced slits extending across the width of the web and including the longitudinal edges thereof, the slits in each line being offset from those in adjacent lines; second means for conveying the web, after slitting, at a greater speed than said first means so as to stretch the web, thereby opening up the slits while distorting out of their original plane the interconnected strip-like portions of the web left between the slits; means for compressing the web laterally to form a cigarette filler; means for enclosing the cigarette filler in a wrapper to form a continuous rod; pressure tappings at longitudinally-spaced points in the area where the web is being compressed; means for comparing the pressure at the two pressure tappings; said second means including means by which the web is stretched to maintain the pressure difference between the two tappings substantially constant; and a cutting device for cutting the continuous rod into individual portions.

8. A cigarette making machine comprising first means for conveying a continuous web of smokable filler material at a predetermined speed towards a slitting mechanism, said slitting mechanism including means for producing slits in the web so as to produce lines of spaced slits extending across the width of the web and including the longitudinal edges thereof, the slits in each line being offset from those in adjacent lines; second means for conveying the web, after slitting, at a greater speed than said first means so as to stretch the web, thereby opening up the slits while distorting out of their original plane the interconnected strip-like portions of the web left between the slits; means for feeding and stretching a second web of smokable material and for superimposing said second web on the first-mentioned web; and a second slitting mechanism for slitting the second web in a similar manner to the first-mentioned web, except that the strip-like portions of the second web are distorted in an opposite sense compared with those of the first-mentioned web, so that the two stretched webs do not nest when superimposed on one another; means for compressing the superimposed webs laterally to form a cigarette filler; means for enclosing the cigarette filler in a wrapper to form a continuous rod; and a cutting device for cutting the continuous rod into individual portions.

9. A cigarette comprising a wrapper surrounding a filler including or consisting of at least two superimposed laterally compressed webs, each being formed with lines of spaced slits extending across the width of the web, the slits in each line being offset from those in adjacent lines, and the webs being longitudinally stretched so that the slits are in an opened up condition and the interconnected strip-like portions of each web left between the slits are generally inclined to planes parallel to the axis of the rod, the strip-like portions of the two webs being oppositely inclined.

* * * * *